US007514882B2

(12) United States Patent
Chang et al.

(10) Patent No.: US 7,514,882 B2
(45) Date of Patent: Apr. 7, 2009

(54) LAMP DRIVING DEVICE AND METHOD

(75) Inventors: Shu-Ming Chang, Hsinhua (TW); Yu-Pei Huang, Hsinhua (TW); Shen-Yao Liang, Hsinhua (TW); Shwang-Shi Bai, Hsinhua (TW)

(73) Assignee: Himax Technologies Limited, Tainan County, Taiwan (CN)

( * ) Notice: Subject to any disclaimer, the term of this patent is extended or adjusted under 35 U.S.C. 154(b) by 0 days.

(21) Appl. No.: 11/485,896

(22) Filed: Jul. 13, 2006

(65) Prior Publication Data

US 2007/0159112 A1 Jul. 12, 2007

(30) Foreign Application Priority Data

Jan. 6, 2006 (TW) ..... 95100636 A

(51) Int. Cl.
*H05B 37/02* (2006.01)

(52) U.S. Cl. ..... 315/291; 315/276; 315/307; 315/361; 315/362

(58) Field of Classification Search ..... 315/203, 315/206, 200 R, 209 R, 219, 224, 276, 308, 315/244, 212, 247, 291, 307, 352, 354, 360–362; 327/239, 257, 536
See application file for complete search history.

(56) References Cited

U.S. PATENT DOCUMENTS

| | | | | |
|---|---|---|---|---|
| 3,949,267 | A * | 4/1976 | Collins | 315/203 |
| 4,998,046 | A * | 3/1991 | Lester | 315/209 R |
| 5,089,925 | A * | 2/1992 | Lester | 361/84 |
| 5,589,793 | A * | 12/1996 | Kassapian | 327/536 |
| 6,181,076 | B1 * | 1/2001 | Trestman et al. | 315/224 |
| 6,326,740 | B1 * | 12/2001 | Chang et al. | 315/291 |
| 6,680,637 | B2 * | 1/2004 | Seo | 327/175 |
| 6,717,374 | B2 * | 4/2004 | Krummel | 315/291 |
| 6,815,906 | B1 * | 11/2004 | Aarons et al. | 315/209 R |
| 6,815,994 | B2 * | 11/2004 | Huber et al. | 327/257 |
| 7,227,317 | B2 * | 6/2007 | Samuelsson | 315/360 |

* cited by examiner

*Primary Examiner*—Douglas W Owens
*Assistant Examiner*—Jimmy T Vu
(74) *Attorney, Agent, or Firm*—The Webb Law Firm

(57) ABSTRACT

A lamp driving device has a pulse width modulation circuit, a phase splitter and several switching circuits. The pulse width modulation circuit is arranged to generate a pulse width modulation signal. The phase splitter is coupled to the pulse width modulation circuit and arranged to split the pulse width modulation signal into several phased signals having different phases, wherein pulses of each phased signal are non-overlapping with those of another phased signal. The switching circuits are coupled to the phase splitter and are arranged to respectively receive one of the phased signals, wherein each switching circuit is controlled by the received phased signal.

11 Claims, 6 Drawing Sheets

LAMP DRIVING DEVICE AND METHOD

RELATED APPLICATIONS

The present application is based on, and claims priority from, Taiwan Application Ser. No. 95100636, filed Jan. 6, 2006, the disclosure of which is hereby incorporated by reference herein in its entirety.

BACKGROUND

1. Field of Invention

The present invention relates to a lamp driving device and method. More particularly, the lamp driving device and method relate to generating several phased signals that have different phases and no overlapping pulses.

2. Description of Related Art

With the rapid development in technology, flat panel displays (FPD) with the advantages of high image quality, compact size, light weight, low driving voltages and low power consumption have become very popular for incorporation into electrical devices and have become the mainstream display apparatus. For example, the FPD can be introduced into a portable TV, mobile phone, video recorder, computer monitor, and many other kinds of consumer electronics.

In the FPD, the backlight module is used as the light source. A lamp driving device in the backlight module is used to drive several cold cathode fluorescent lamps (CCFL), and to adjust the brightness of these CCFLs. FIG. 1 is a functional block diagram depicting a lamp driving device of the prior art. The lamp driving device 100 has a pulse width modulation circuit (PWM) 110, and several bridge circuits 141, 142, 143 and 149. The pulse width modulation circuit 110 is arranged to generate several driving signals 131, 132, 133, and 139. The bridge circuits 141, 142, 143 and 149 are coupled to the pulse width modulation circuit 110 and are arranged to respectively receive one of the driving signals 131, 132, 133, and 139, wherein each bridge circuit is driven by the received PWM signal. The bridge circuits 141, 142, 143 and 149 are respectively coupled to several transformers 151, 152,153, and 159 to individually adjust the output voltages of the bridge circuits 141, 142, 143 and 149. Furthermore, the transformers 151, 152, 153, and 159 are respectively coupled to one of the cold cathode fluorescent lamps 161, 162, 163, and 169. The lamp driving device 100 thereby drives several cold cathode fluorescent lamps 161, 162, 163, and 169 by the method depicted in the figure.

For example, the pulse width modulation circuit 110 of the lamp driving device 100 generates two driving signals 131 and 132. The driving signal 131 drives the cold cathode fluorescent lamp 161 by the transformation of the bridge circuit 141 and the transformer 151. The driving signal 132 drives the cold cathode fluorescent lamp 162 by the transformation of the bridge circuit 142 and the transformer 152. Therefore, the lamp driving device 100 can drive the cold cathode fluorescent lamps 161 and 162 simultaneously.

However, the driving signals 131, 132, 133, and 139 described above have the same waveforms and identical phases without phase differences. Thus, the lamp driving device 100 is encumbered with bigger instant output loading, and may generate heavier electromagnetic interference (EMI) that affects other electrical devices. Therefore, a lamp driving device and method to reduce the instant output loading and the electromagnetic interference is needed.

SUMMARY

It is therefore an aspect of the present invention to provide a lamp driving device and method.

It is therefore another aspect of the present invention to provide a lamp driving device and method that can generate several phased signals with different phases for each other.

It is therefore another aspect of the present invention to provide a lamp driving device and method that can reduce the instant output loading and the electromagnetic interference.

According to one preferred embodiment of the present invention, the lamp driving device has a pulse width modulation circuit, a phase splitter and several switching circuits. The pulse width modulation circuit is arranged to generate a pulse width modulation signal. The phase splitter is coupled to the pulse width modulation circuit and arranged to split the pulse width modulation signal into several phased signals having different phases, wherein pulses of each phased signal are non-overlapping with those of another phased signal. The switching circuits are coupled to the phase splitter and are arranged to respectively receive one of the phased signals, wherein each switching circuit is controlled by the received phased signal.

According to one preferred embodiment of the present invention, the lamp driving device has a pulse width modulation circuit, a phase splitter and several bridge circuits. The pulse width modulation circuit is arranged to generate a pulse width modulation signal. The phase splitter is coupled to the pulse width modulation circuit and arranged to split the pulse width modulation signal into several phased signals having different phases, wherein pulses of each phased signal are non-overlapping with those of another phased signal. The bridge circuits are coupled to the phase splitter and are arranged to respectively receive one of the phased signals, wherein each bridge circuit is controlled by the received phased signal.

It is to be understood that both the foregoing general description and the following detailed description are examples and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
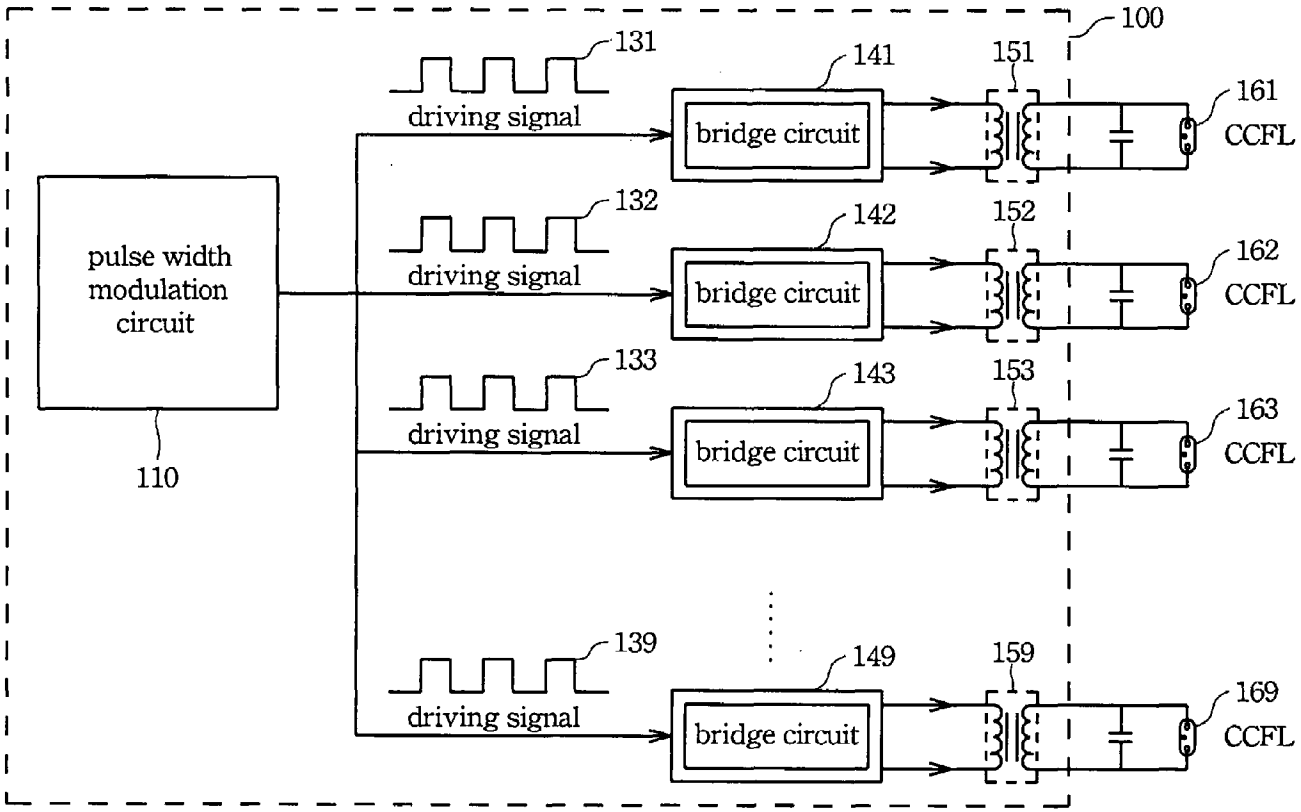
Fig. 1 (prior art)
FIG. 1 is a functional block diagram depicting a lamp driving device of the prior art.

Reference will now be made in detail to the present preferred embodiments of the invention, examples of which are illustrated in the accompanying drawings. Wherever possible, the same reference numbers are used in the drawings and the description to refer to the same or like parts.

The present invention offers a lamp driving device and method that can generate the phased signals with different phases to drive a backlight module. The phased signals have different phases and no overlapping pulses. Therefore, the instant output loading and the electromagnetic interference effect are reduced.

Figure 2:
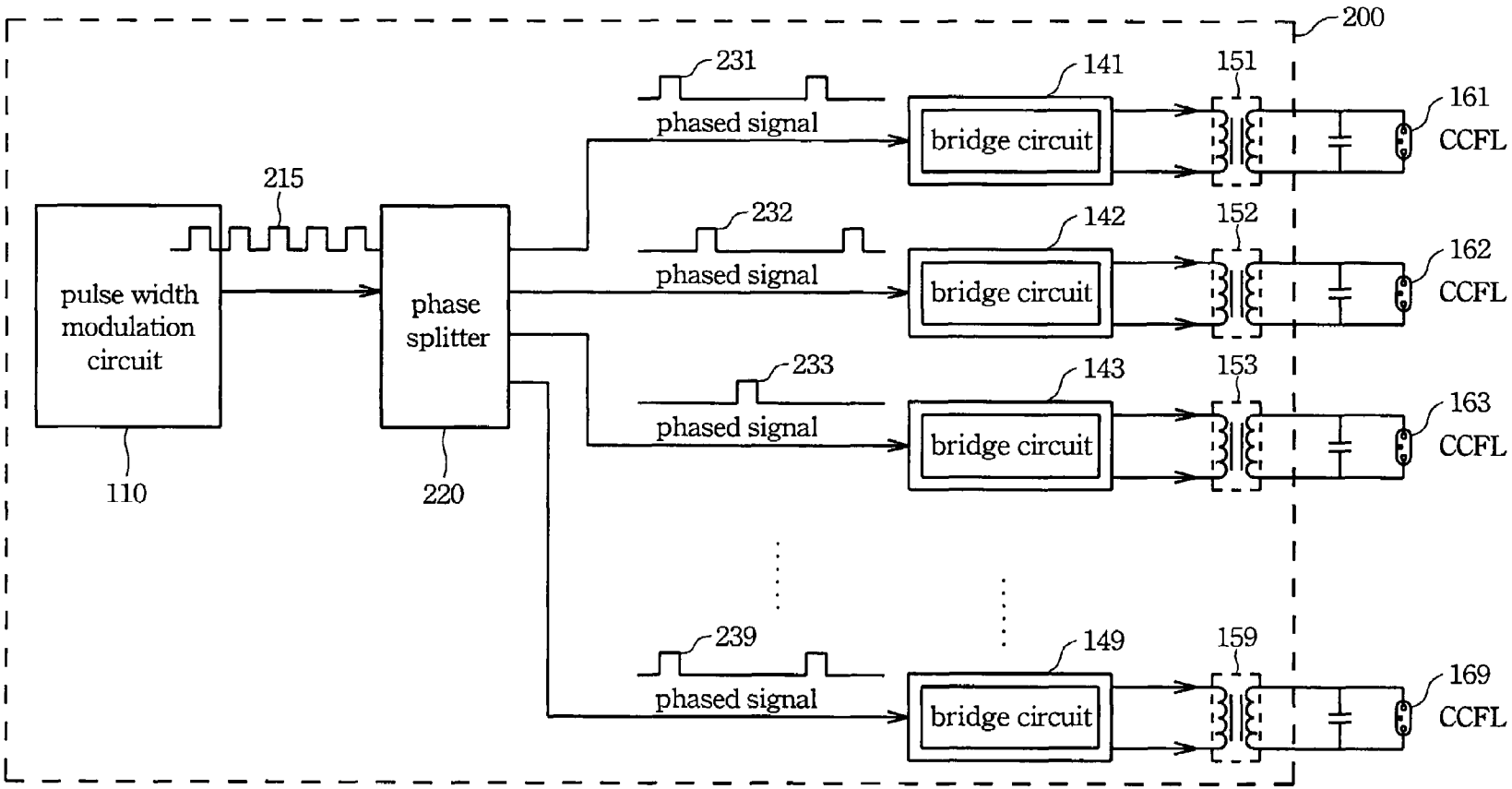
FIG. 2 is a functional block diagram depicting a lamp driving device of one preferred embodiment of the present invention.

FIG. 2 is a functional block diagram depicting a lamp driving device of one preferred embodiment of the present invention. The lamp driving device 200 separates a pulse width modulation signal 215 into several phased signals 231, 232, 233 and 239. The lamp driving device 200 has a pulse width modulation circuit 110, a phase splitter 220 and several bridge circuits 141, 142, 143 and 149. The pulse width modulation circuit 110 is arranged to generate a pulse width modulation signal 215. The phase splitter 220 coupled to the pulse width modulation circuit 110 is arranged to separate the pulse width modulation signal 215 into several phased signals 231, 232, 233 and 239 having different phases, wherein phases of each phased signal are non-overlapping with those of another phased signal. The bridge circuits 141, 142, 143 and 149 coupled to the phase splitter 220 are arranged to respectively receive one of the phased signals 231, 232, 233 and 239, wherein each bridge circuit is controlled by the received phased signal.

Furthermore, the bridge circuits 141, 142, 143 and 149 are respectively coupled to the primary windings of several transformers 151, 152, 153 and 159 to one-to-one adjust the output voltages of the bridge circuits 141, 142, 143 and 149 to fit in with the output loading. The cold cathode fluorescent lamps 161, 162, 163 and 169 are respectively coupled to the secondary windings of the transformers 151, 152, 153 and 159. For example, when the lamp driving device 200 separates a pulse width modulation signal into three phased signals, the frequencies and duties of the phased signals become one third of the original pulse width modulation signal. In other respects, in order to sustain the requirement of output loading, the transformers can be arranged to increase the output voltage for keeping the original output power. In an embodiment, the bridge circuit is a full-bridge circuit or a half-bridge circuit. Each bridge circuit includes switches and being controlled by one of the phased signals to conduct a current alternately flowing to and from a primary winding of one of the transformers.

The transformers 151, 152, 153 and 159 are respectively coupled to one of the cold cathode fluorescent lamps 161, 162, 163 and 169. The lamp driving device 200 thereby drives several cold cathode fluorescent lamps 161, 162, 163 and 169 by the method depicted in the figure. Furthermore, the transformers 151, 152, 153 and 159 are also arranged to adjust the output voltage to change the brightness of the cold cathode fluorescent lamps 161, 162, 163 and 169.

For example, the pulse width modulation signal 215 generated by the pulse width modulation circuit 110 of the lamp driving device 200 is separated into two phased signals 231 and 232. The phased signal 231 drives the cold cathode fluorescent lamp 161 by transforming the bridge circuit 141 and the transformer 151. The phased signal 232 drives the cold cathode fluorescent lamp 162 with the transformation of the bridge circuit 142 and the transformer 152. Therefore, the lamp driving device 200 can drive the cold cathode fluorescent lamps 161 and 162 simultaneously.

The functions of the lamp driving device 200 are generating a pulse width modulation signal, splitting the pulse width modulation signal into a plurality of phased signals that have different phases, and delivering power to each of a plurality of loads in response to one of the phased signals. Wherein pulses of each phased signal are non-overlapping with those of another phased signal. The pulse width modulation circuit 110 can generate a pulse width modulation signal. There are many ways of separating the pulse width modulation signal into several phased signals that have different phases and no overlapping pulses. Bellow are two embodiments of the phase splitter 220.

Figure 3:
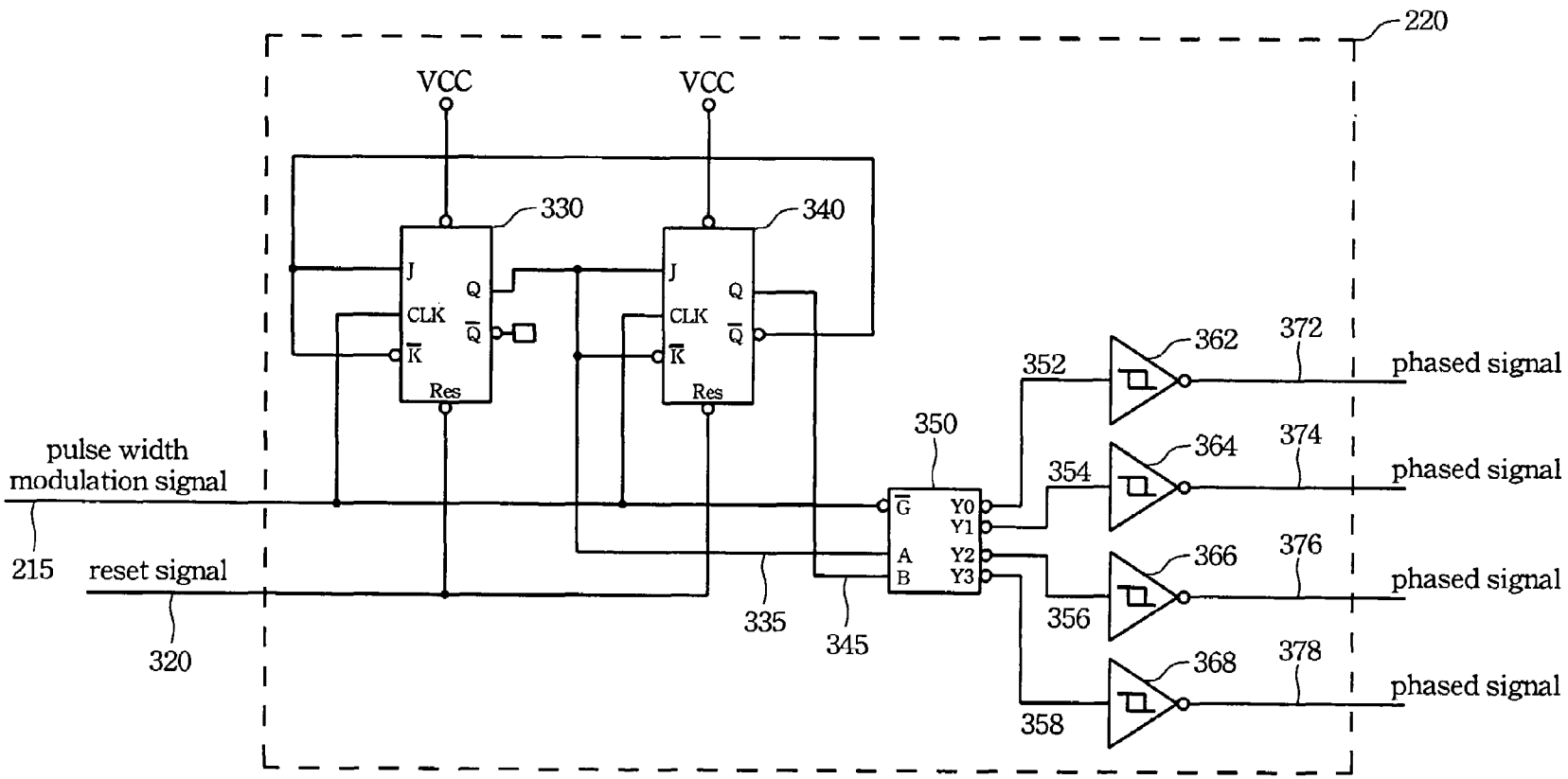
FIG. 3 is a functional block diagram depicting a phase splitter of a preferred embodiment of the present invention.

FIG. 3 is a functional block diagram depicting a phase splitter of a preferred embodiment of the present invention. The embodiment can be used to separate a pulse width modulation signal into four phased signals. The phase splitter 220 is made up of two flip-flops 330 and 340, a decoder 350, and four inverters 362, 364, 366 and 368. The flip-flops 330 and 340 are coupled to the pulse width modulation circuit and arranged to receive a pulse width modulation signal 215 and a reset signal 320. The flip-flop 330 generates a flip-flop signal 335 and offers logic signals for the flip-flop 340 to generate a flip-flop signal 345. The decoder 350 is coupled to the pulse width modulation circuit and arranged to receive the pulse width modulation signal 215, the decoder is also coupled to the flip-flops 330 and 340 and arranged to receive the flip-flop signals 335 and 345. Thus, the decoder 350 generates the decoder signals 352, 354, 356 and 358 according to the pulse width modulation signal 215, the flip-flop signals 335 and 345. The inverters 362, 364, 366 and 368 are coupled to the decoder and used to receive the decoder signals 352, 354, 356 and 358 to generate the phased signals 372, 374, 376 and 378.

Figure 3A:
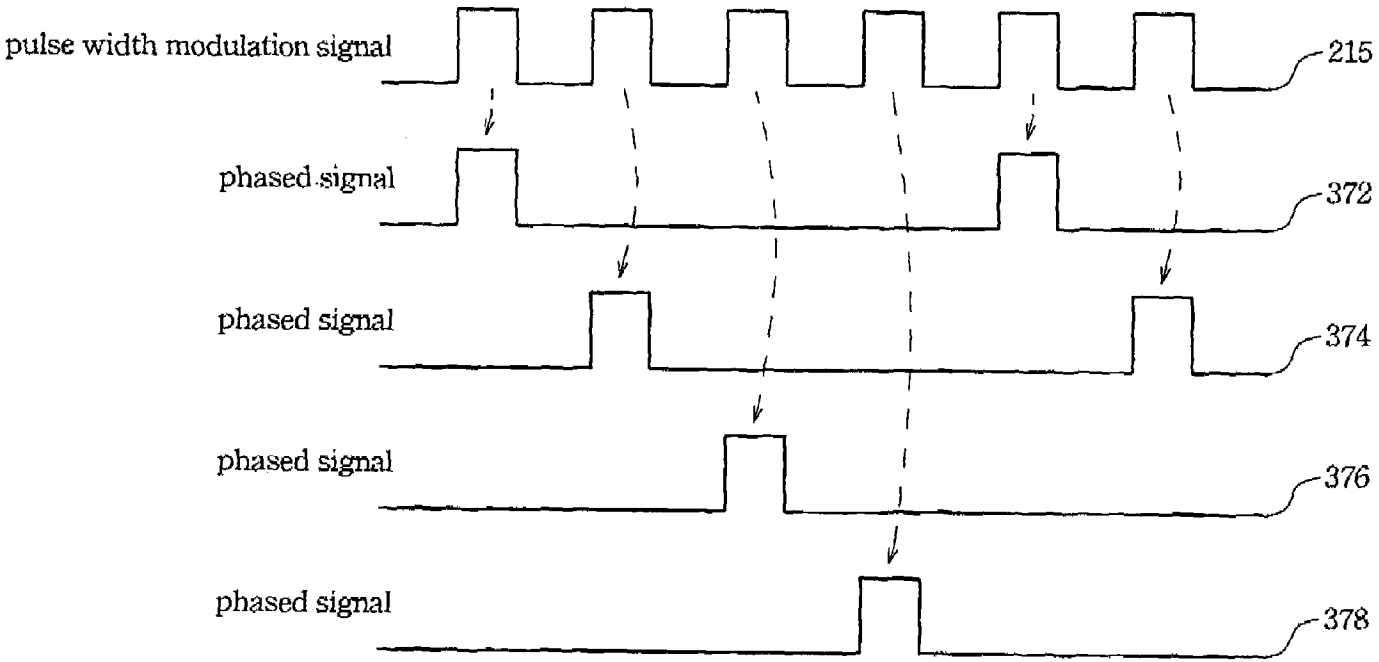
FIG. 3A is a waveform diagram depicting the phased signals generated by the phase splitter of a preferred embodiment of the present invention.

FIG. 3A is a waveform diagram depicting the phased signals generated by the phase splitter of a preferred embodiment of the present invention. The figure depicts the pulse width modulation signal 215, the phased signals 372, 374, 376 and 378 of FIG. 3. The figure shows that the pulse width modulation signal 215 is separated into the phased signals 372, 374, 376 and 378 by the phase splitter 220. The phased signals 372, 374, 376 and 378 that have different phases of 90°, 180°, 270° and 360°. The phased signals 372, 374, 376 and 378 have no overlapping pulses. Therefore, the instant output loading and the electromagnetic interference are reduced. Furthermore, the designer can modify the design of the phase splitter according to the requirements, such as using more flip-flops, different decoder and more inverters when more phased signals need to be outputted.

Figure 4:
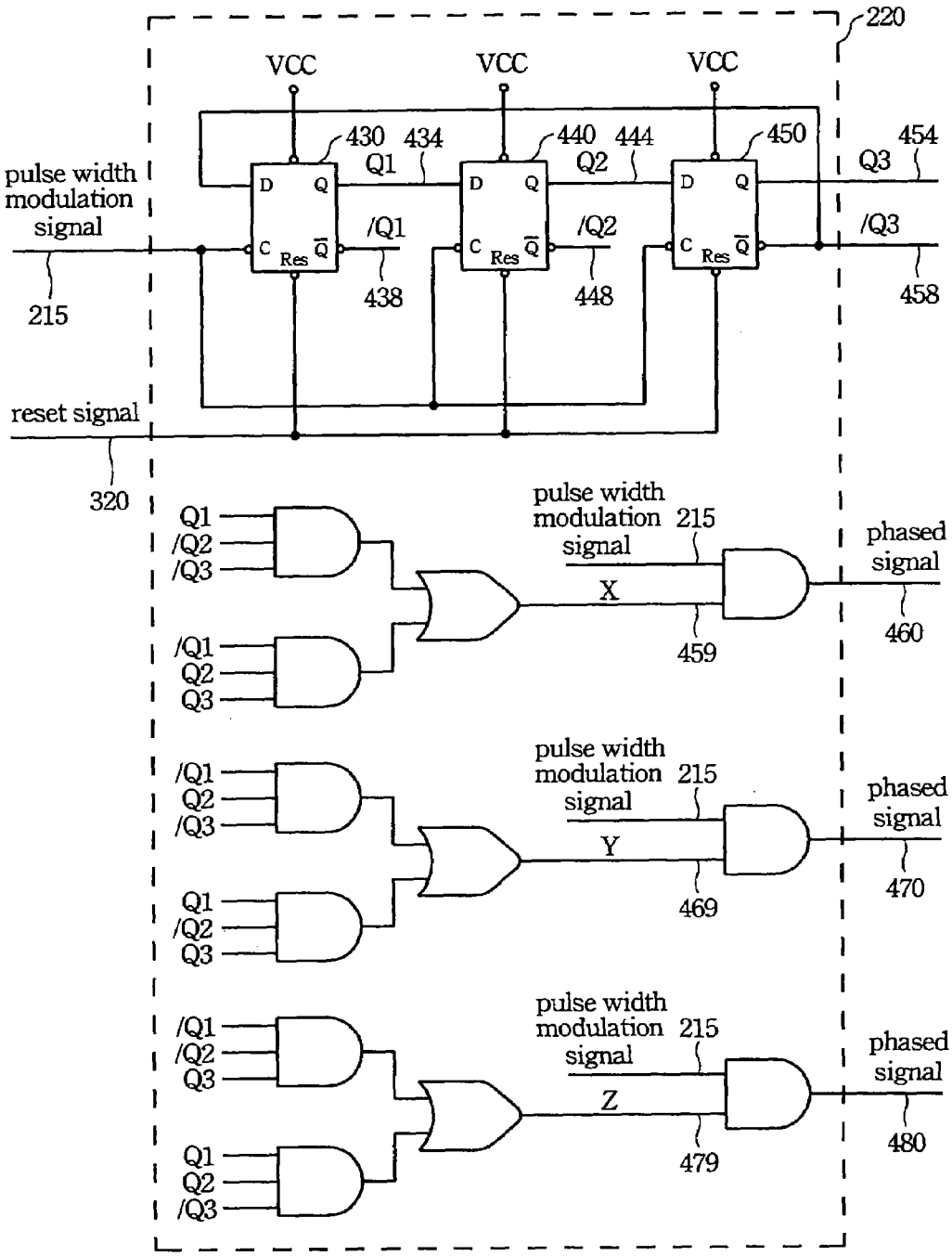
FIG. 4 is a functional block diagram depicting a phase splitter of another preferred embodiment of the present invention.

FIG. 4 is a functional block diagram depicting a phase splitter of another preferred embodiment of the present invention. The embodiment is based on is another method to separate a pulse width modulation signal into three phased signals. The phase splitter 220 has three flip-flops 430, 440 and 450, and several logic gates. The flip-flops 430, 440 and 450 are coupled to the pulse width modulation circuit and arranged to receive a pulse width modulation signal 215 and a reset signal 320. The flip-flop 430 generates the flip-flop signals 434 and 438, the flip-flop 440 generates the flip-flop signals 444 and 448 according to the flip-flop signal 434, and the flip-flop 450 generates the flip-flop signals 454 and 458 according to the flip-flop signal 444. The phased signals 460, 470, and 480 are generated by the calculations of several logic gates that deal with the flip-flop signals 434, 438, 444, 448, 454, 458 and the pulse width modulation signal 215. The logic gate signals 459, 469 and 479 are generated during the calculation process of the logic gates. This embodiment uses six three-input-signals AND logic gates to receive the combinations of the flip-flop signals 434, 438, 444, 448, 454 and 458, and then uses three two-input-signals OR logic gates to respectively generate the logic gate signals 459, 469 and 479. Furthermore, this embodiment uses three two-input-signals AND logic gates to deal with the pulse width modulation signal 215 and the logic gate signals 459, 469 and 479 for generating the phased signals 460, 470, and 480.

Figure 4A:
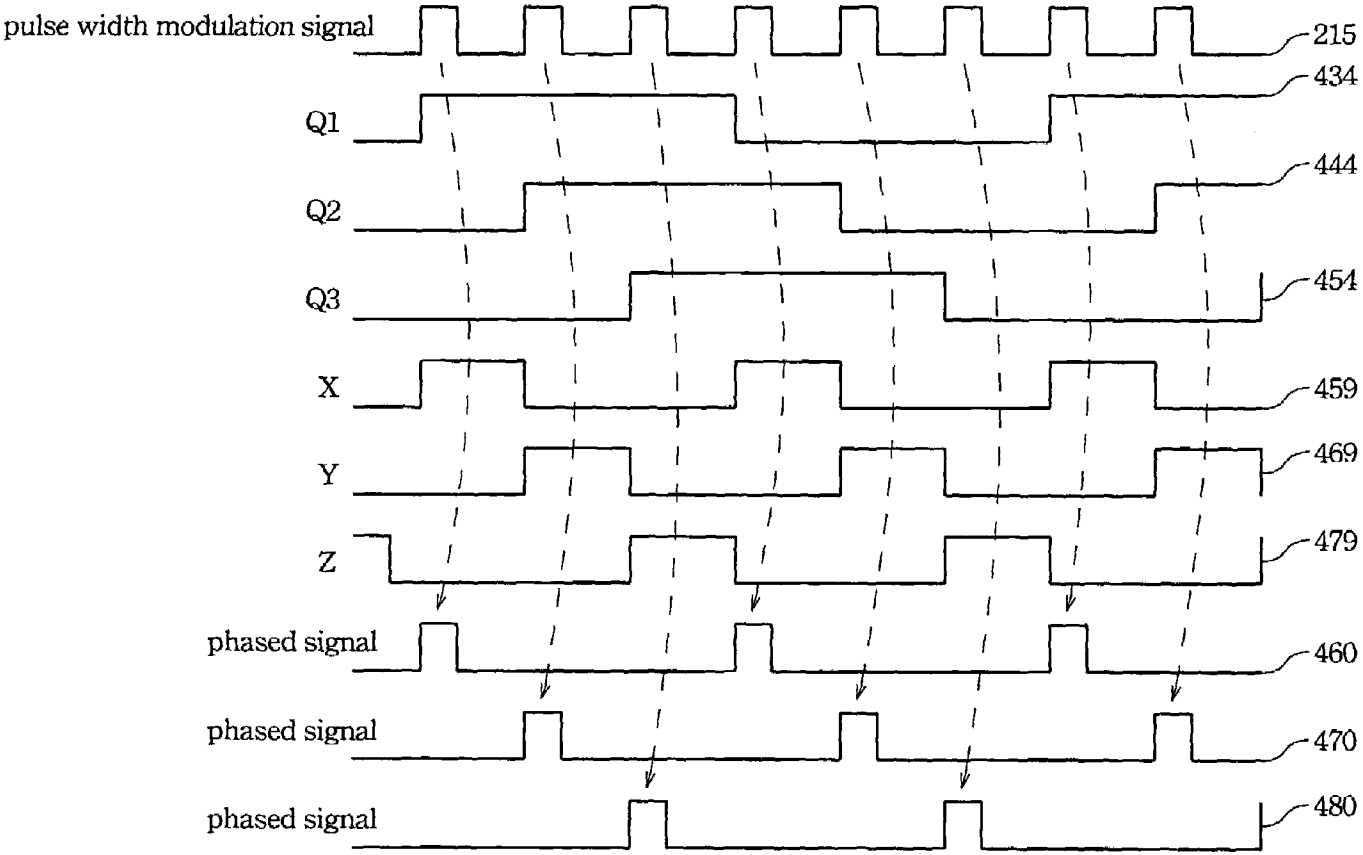
FIG. 4A is a waveform diagram depicting the phased signals generated by the phase splitter of another preferred embodiment of the present invention.

FIG. 4A is a waveform diagram depicting the phased signals generated by the phase splitter of another preferred embodiment of the present invention. The figure depicts the pulse width modulation signal 215, the flip-flop signals 434, 444, 454, logic gate signals 459, 469, 479, phased signals 460, 470, and 480 of FIG. 4. The figure shows that the pulse width modulation signal 215 is separated into the phased signals 460, 470, and 480 by the phase splitter 220. The phased signals 460, 470, and 480 have different phases of 120°, 240° and 360°. The phased signals 460, 470, and 480 also have no overlapping pulses. Therefore, the instant output loading and the electromagnetic interference are reduced. Furthermore, the designer can modify the design of the phase splitter according to the requirements, such as using more flip-flops and different combinations of logic gates when more phased signals needs to be outputted.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A lamp driving device, comprising:

a pulse width modulation circuit arranged to generate a pulse width modulation signal;

a phase splitter coupled to the pulse width modulation circuit and arranged to split the pulse width modulation signal into a plurality of phased signals having different phases, wherein pulses of each phased signal are non-overlapping with those of another phased signal, wherein the phase splitter comprises:

a plurality of flip-flops coupled to the pulse width modulation circuit, and arranged to receive the pulse width modulation signal and a reset signal to generate flip-flop signals; and a plurality of logic gates coupled to the pulse width modulation circuit and the flip-flops, and arranged to receive the pulse width modulation signal and the flip-flop signals to generate the phased signals;

a plurality of transformers each having a secondary winding respectively coupled to a lamp; and a plurality of bridge circuits each having a plurality of switches and being controlled by corresponding one of the phased signals to conduct a current alternately flowing to and from a primary winding of corresponding one of the transformers.

2. The lamp driving device as claimed in claim 1, further comprising a plurality of transformers individually coupled to the bridge circuits.

3. The lamp driving device as claimed in claim 2, wherein each transformer is arranged to drive a cold cathode fluorescent lamp.

4. The lamp driving device as claimed in claim 1, wherein the phase splitter comprises a flip-flop, a decoder, or an inverter.

5. The lamp driving device as claimed in claim 1, wherein the phase splitter comprises a flip-flop or a logic gate.

6. A lamp driving method comprising the steps of:

generating a pulse width modulation signal;

splitting the pulse width modulation signal into a plurality of phased signals having different phases, wherein pulses of each phased signal are non-overlapping with those of another phased signal; and delivering phased signals to a plurality of bridge circuits respectively, wherein each bridge circuit having a plurality of switches and being controlled by corresponding one of the phased signals to conduct a current alternately flowing to and from a corresponding transformer to generate power to each of a plurality of loads in response to corresponding one of the phased signals, wherein the pulse width modulation signal is split by using a phase splitter, the pulse width modulation signal is split by the steps of:

using a plurality of flip-flops to generate a plurality of flip-flop signals according to the pulse width modulation signal and a reset signal generated by the pulse width modulation circuit;

using at least one decoder to generate a plurality of decoder signals according to the pulse width modulation signal and the flip-flop signals; and using a plurality of inverters to generate the phased signals according to the decoder signals.

7. The lamp driving method as claimed in claim 6, wherein the power is delivered to the loads through a plurality of transformers.

8. The lamp driving method as claimed in claim 7, wherein the loads are cold cathode fluorescent lamps.

9. The lamp driving method as claimed in claim 6, wherein the pulse width modulation signal is generated by using a pulse width modulation circuit.

10. A lamp driving device, comprising:

a pulse width modulation circuit arranged to generate a pulse width modulation signal;

a phase splitter coupled to the pulse width modulation circuit and arranged to split the pulse width modulation signal into a plurality of phased signals having different phases, wherein pulses of each phased signal are non-overlapping with those of another phased signal, wherein the phase splitter comprises:

a plurality of flip-flops coupled to the pulse width modulation circuit and arranged to receive the pulse width modulation signal and a reset signal to generate a plurality of flip-flop signals;

at least one decoder coupled to the pulse width modulation circuit and the flip-flops, and arranged to receive the pulse width modulation signal and the flip-flop signals to generate a plurality of decoder signals; and a plurality of inverters coupled to the decoder and arranged to receive the decoder signals to generate the phased signals;

a plurality of transformers each having a secondary winding respectively coupled to a lamp; and a plurality of bridge circuits each having a plurality of switches and being controlled by corresponding one of the phased signals to conduct a current alternately flowing to and from a primary winding of corresponding one of the transformers.

11. A lamp driving method comprising the steps of:

generating a pulse width modulation signal;

splitting the pulse width modulation signal into a plurality of phased signals having different phases, wherein pulses of each phased signal are non-overlapping with those of another phased signal; and delivering phased signals to a plurality of bridge circuits respectively, wherein each bridge circuit having a plurality of switches and being controlled by corresponding one of the phased signals to conduct a current alternately flowing to and from a corresponding transformer to generate power to each of a plurality of loads in response to corresponding one of the phased signals, wherein the pulse width modulation signal is split by using a phase splitter, the pulse width modulation signal is split by the steps of:

using a plurality of flip-flops to generate flip-flop signals according to the pulse width modulation signal and a reset signal generated by the pulse width modulation circuit; and using a plurality of logic gates to generate the phased signals according to the pulse width modulation signal and the flip-flop signals.

* * * * *